United States Patent [19]

Moutray, III

[11] Patent Number: 4,470,456

[45] Date of Patent: Sep. 11, 1984

[54] BOREHOLE SAMPLING TOOL

[76] Inventor: Waldo W. Moutray, III, P.O. Box 1904, Abilene, Tex. 79604

[21] Appl. No.: 468,138

[22] Filed: Feb. 22, 1983

[51] Int. Cl.[3] ..... E21B 49/08

[52] U.S. Cl. ..... 166/100; 73/155

[58] Field of Search ..... 166/100, 264; 73/155

[56] References Cited

U.S. PATENT DOCUMENTS

| | | | |
|---|---|---|---|
| 3,254,531 | 6/1966 | Briggs, Jr. | 73/155 |
| 3,577,782 | 5/1971 | Aitken | 73/155 |
| 4,292,842 | 10/1981 | Hallmark | 73/155 |

FOREIGN PATENT DOCUMENTS

| | | | |
|---|---|---|---|
| 737272 | 6/1966 | Canada | 166/264 |

*Primary Examiner*—Ernest R. Purser
*Assistant Examiner*—Thuy M. Bui
*Attorney, Agent, or Firm*—Wm. T. Wofford; James C. Fails; Arthur F. Zobal

[57] ABSTRACT

A borehole tool member has an elongated slot with a surrounding seal for engaging the wall of the borehole for sampling fluid from the subsurface formations. A passage extends from the slot through a portion of the tool member to an upper opening which is connected to a conduit that extends to the surface. The seal surrounding the slot is forced against the borehole wall by two pistons located in two cylindrical chambers formed into the tool member. The pistons are actuated for movement outward of the tool member by fluid under pressure injected from the surface by way of a pressure control line extending from the surface to a second passage formed in the tool member and which extends to the two cylindrical chambers. Springs are provided for returning the pistons inward upon release of the fluid pressure in the cylindrical chambers.

18 Claims, 6 Drawing Figures

BOREHOLE SAMPLING TOOL

BACKGROUND OF THE INVENTION

1. Field of the Invention

The present invention relates to a tool which may be used to obtain a sample of the fluid in a subsurface formation traversed by a borehole.

2. Description of the Prior Art

One known borehole sampling tool for open hole testing of fluids from the formations uses packers, for isolation purposes, that completely surround the tool. These tools have disadvantages in that the packers are large and bulky and are easily "hung up" in the borehole. Problems occur also in washed out areas with the use of such packers. Another known borehole sampling tool is a wire line tool that must be retrieved to obtain the fluid sample collected. The use of such a tool is time consuming and expensive.

SUMMARY OF THE INVENTION

It is an object of the present invention to provide a borehole tool that can be used for fluid sampling purposes that avoids the above problems.

The tool comprises an elongated tool member adapted to be located in a borehole at the level of a subsurface formation of interest. An elongated slot is formed into the tool member from the exterior thereof along its length on one side. Seal means on the exterior of the tool member surrounds the opening of the slot and extends outward beyond the outer wall of the tool member. First fluid passage means extends from the slot through a portion of the tool member to an upper opening formed in the tool member for connection to a conduit which is to extend from the surface. Upper and lower spaced apart cylindrical chambers are formed into the tool member from the exterior thereof on a side opposite said one side. Upper and lower pistons are located in said upper and lower cylindrical chambers respectively and are adapted to be moved to outward and inward positions. Second fluid passage means is formed in said tool member for connection to a pressure control conduit adapted to extend to the surface to a source of fluid under pressure. Said second fluid passage means extends to said upper and lower cylindrical chambers for allowing fluid under pressure to be injected into said upper and lower cylindrical chambers for moving said upper and lower pistons outward for engaging one side of the borehole wall for moving said seal means of said tool member against the other side of the borehole wall. Means is provided for returning the upper and lower pistons to their inward positions when the fluid pressure in the upper and lower cylindrical chambers is released.

In a further aspect, mechanical springs are provided for returning the upper and lower pistons to their inward positions when the fluid pressure in the upper and lower cylindrical chambers is released.

DESCRIPTION OF THE PREFERRED EMBODIMENT

Figure 1:
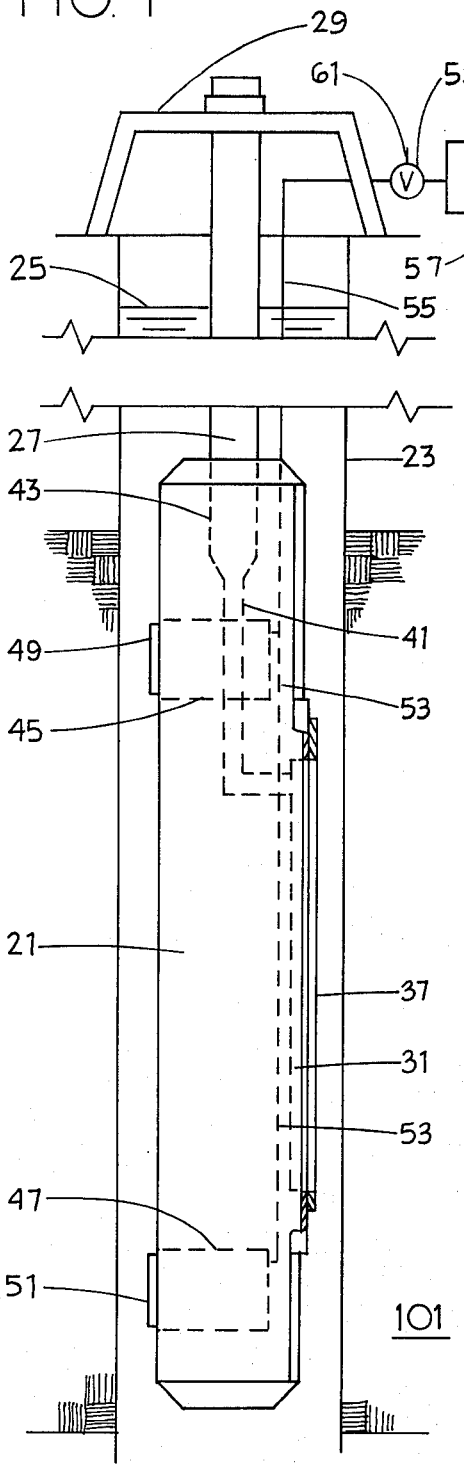
FIG. 1 is a side view of the borehole tool of the present invention with its pistons in retracted positions.
Figure 2:
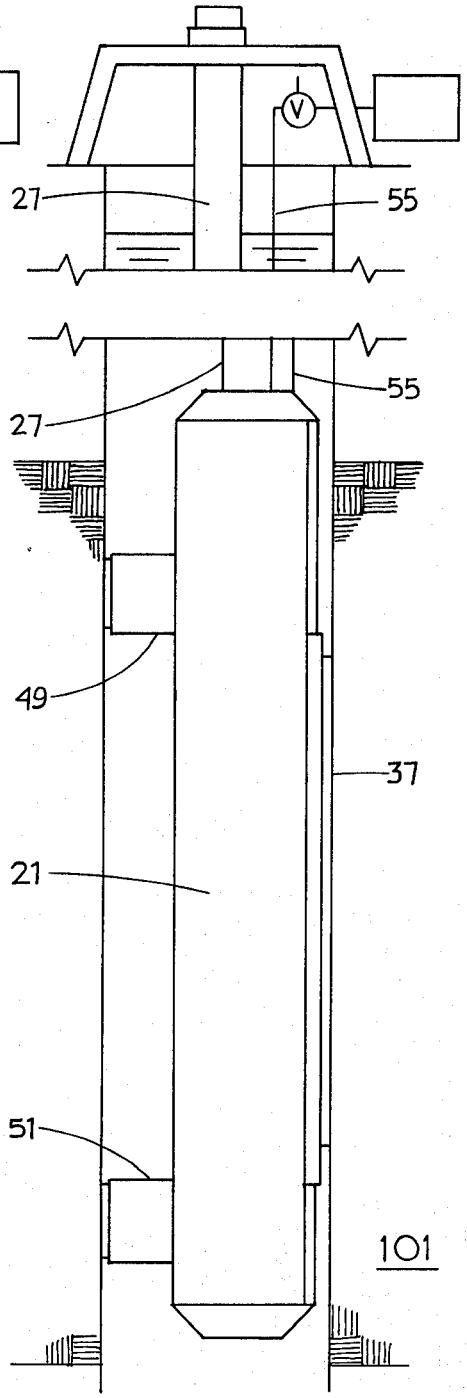
FIG. 2 is a side view of the borehole tool of the present invention with its pistons extended outward for urging the seal around its sampling slot against the borehole wall.
Figure 3:
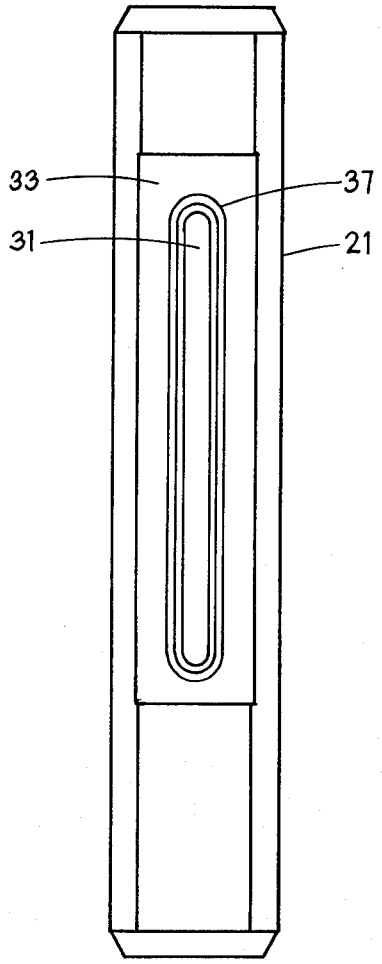
FIG. 3 is a port side of the borehole tool of the present invention.

Referring now to the drawings, the borehole tool of the present invention is identified at 21. It is adapted to be located in an open borehole illustrated at 23 that has been left full of drilling fluids, illustrated at 25. The tool 21 is a sidewall testor and is employed for isolating and thus allowing the testing of any porous strata traversed by the borehole. In the borehole, the tool is supported by a tubular string of pipe 27 supported by some kind of derrick structure and drawworks (a drilling rig or well service unit). In FIGS. 1 and 2, the tubing string 27 is shown supported by a portion of a drilling rig 29. The tool is controlled from the surface, and when it is in position at the level of a porous strata of interest, it is then set into place and allows the sampling or removal of any substance, oil, gas, or water, from the porous strata.

The tool may be set, and released as many times as is necessary to thoroughly test any porous zone traversed by the borehole. Any oil, gas, or water that is present within this porous zone will be capable of passing through the tool and into the tubular string which supports the tool. From the tubular string, the fluid can be conveyed to the surface by external lifting.

It is also possible for fluid or gas to be introduced into porous strata traversed by the borehole, through the tool. For example, acid or water could be pumped from the surface through the tubing string, through the tool, and thus into the porous strata.

The tool 21 is formed of solid metal, preferrably cast iron. It has various passages bored out for allowing it to perform its function. On one side of the tool, an elongated slot 31 is formed from the exterior of the tool inward a short distance. A steel plate 33 is attached by bolts 35 to the side of the tool around the slot 31. The plate 33 has an opening 33A formed therethrough which has a width and length coinciding with the width and length of the slot 31. The opening 33A is in alignment with the slot 31 such that the opening 33A forms part of the slot 31. A seal 37 is attached to the exterior of the plate 33 and surrounds the opening 33A and hence the opening of the slot 31. The seal 37 preferrably is an elastic member and may be formed of conventional synthetic rubber such as neoprene. It may be molded onto the steel plate 33. The plate 33 can be removed to allow the ready exchange of a damaged seal or of a seal of different size or shape.

A passage 41 extends from the upper end of the slot 31 through member 21 to an upper opening 43. The passage 41 comprises a lower portion 41A which splits into two paths 41B and 41C that are joined at 41D. The lower end of the tubing string 27 is connected to the opening 43, for example, by a threaded connection.

Upper and lower cylindrical chambers 45 and 47 are formed into the tool member 21 from a side opposite the slot 31 and seal 37. Upper and lower pistons 49 and 51 are located in the chambers 45 and 47 respectively. The pistons 49 and 51 are adapted to be moved to inward positions as shown in FIG. 1 and to outward positions as shown in FIG. 2 for engaging one side of the borehole wall to move the tool and hence the seal against the opposite side of the borehole wall. Normally the pistons 49 and 51 are maintained in their inward positions by mechanical springs. The pistons are actuated to move outward by fluid pressure such as by hydraulic or pneumatic pressure supplied from the surface. A passage 53 extends from the upper end of the tool 21 through the tool to the chambers 45 and 47 for supplying fluid pressure to the chambers. A flexible hose or pipe 55 is connected to the passage 53 and extends to the surface to a source 57 of air or hydraulic fluid under pressure. The hose 55 may be connected to the passage 53 by a threaded connection. A three way valve 59 is coupled to the hose 55 at the surface for connecting the source 57 to the hose 55 or for venting the hose 55 to the atmosphere by way of a vent 61.

Figure 4:
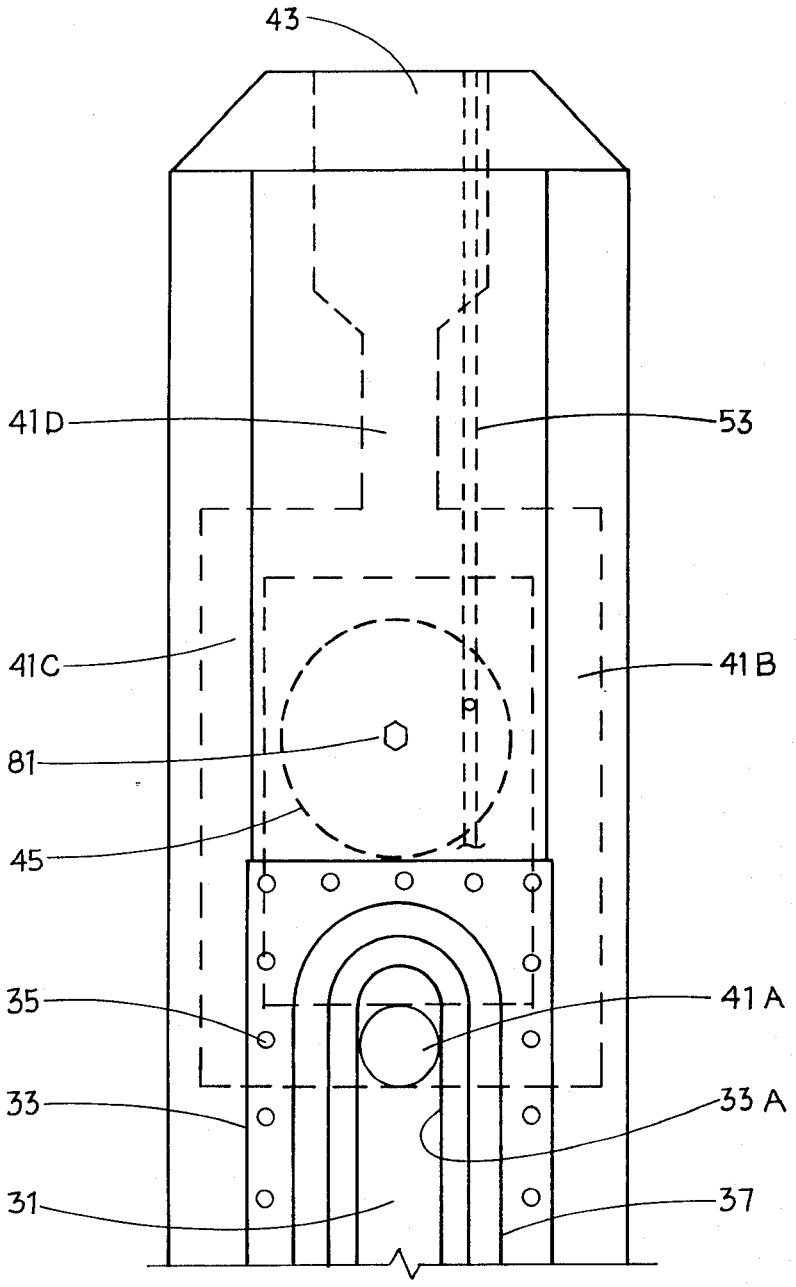
FIG. 4 is an enlarged view of the top portion of the tool of FIGS. 1–3 as seen from the port side.
Figure 5:
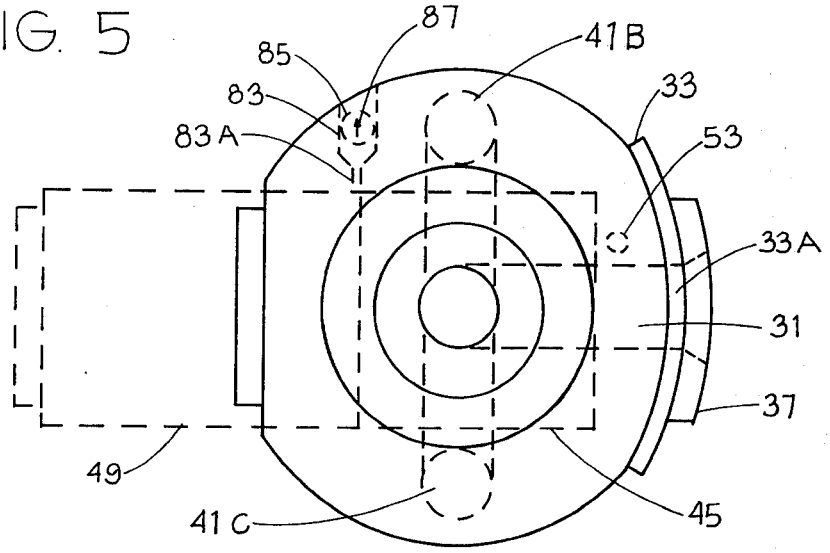
FIG. 5 is a top end view of the tool of the present invention.
Figure 6:
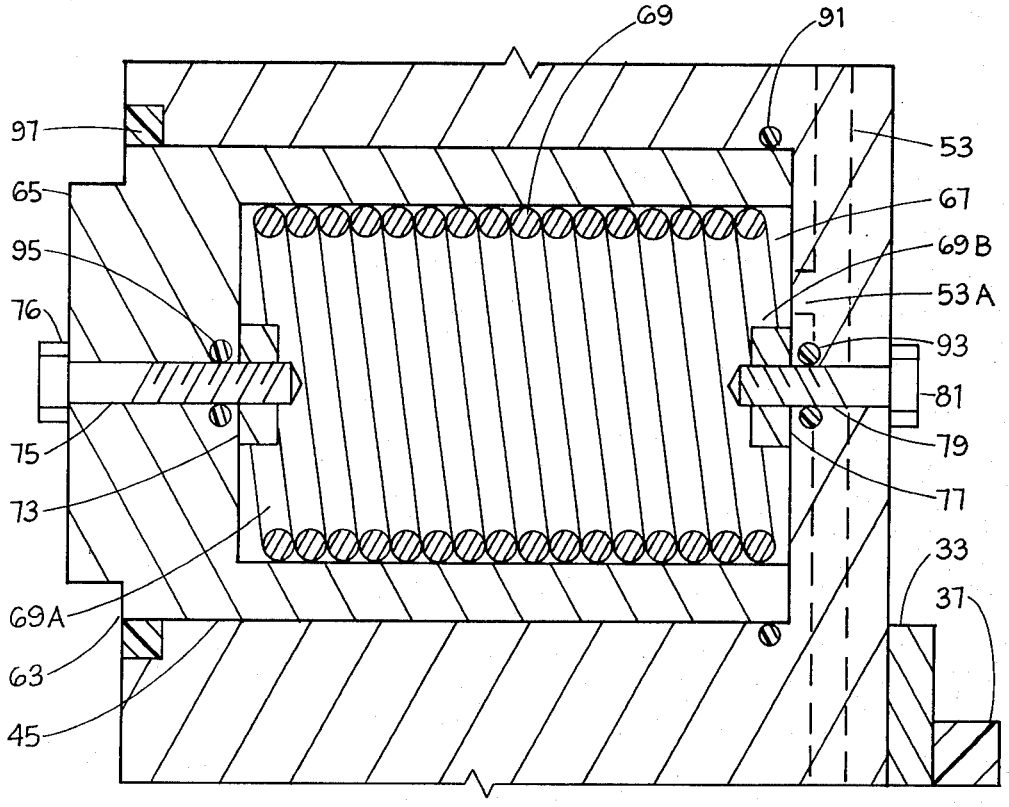
FIG. 6 is an enlarged partial cross sectional view of a piston and cylinder of the borehole tool of the present invention.

The upper and lower pistons, their cylindrical chambers, and their manner of operation are identical. Referring to FIGS. 4 and 5, only the upper piston 49 and cylindrical chamber 45 will be described in detail. The cylindrical chamber 45 is bored into the tool 21 from a side opposite the slot 31 and seal 37. The piston 49 has an outward facing end 63 with a reduced diameter head 65. The opposite end of the piston 49 has an opening 67 formed therein in which is located a mechanical spring 69. The spring 69 has its two ends 69A and 69B fixedly secured (welded) to two nuts 71 and 73 respectively. A small hole 75 is formed through the end 63 of the piston 49 and a bolt 77 is inserted therein and screwed into the nut 75 securing one end of the spring 69 to the end 63 of the piston 49. The tool 21 has a small hole 79 formed through its wall to the chamber 45 on the side of the slot 31. A bolt 81 is inserted through the hole 79 and is screwed to the nut 71. Thus the other end of the spring 69 is secured to the wall of the tool 21 whereby the spring 69 normally maintains the piston 49 in its retracted or inward position in the cylindrical chamber 45. When fluid under pressure is injected into the passage 53, it flows by way of passage 53A into the opening 67 of the piston 49 and hence into the chamber 45 and forces the piston 49 to its outward position as shown in FIGS. 2 and 5. When the fluid pressure in the chamber 45 and passage 53 is released, the spring 69 pulls the piston back into its retracted position.

Referring to FIG. 5, a relief passage or port 83 extends from the chamber 45 outward to the exterior of the tool 21 near the forward end of the chamber 45 for the passage of fluid in the chamber outward if the back end of the piston 49 travels beyond the port 83. The relief port 83 thus limits the outward distance of travel of the piston 49. Member 85 is a one way valve located in the port 83 that allows fluid to flow through the port 83 only in the direction of the arrow 87 thereby preventing fluid from the borehole from flowing into the chamber 45. The diameter of the entrance 83A to the relief port 83 is smaller than the diameter of the passage 53. Any release of fluid pressure through the relief ports in the cylindrical chambers 45 and 47 is monitered at the surface.

Members 91, 93, and 95 are O-ring seals and member 97 is a mud seal.

The piston 51 and its internal spring operate in the same manner as the piston 49 and its internal spring 69.

In using the tool 21, the pipe 27 is connected to the opening 43 of the tool and the hose 55 is connected to the passage 53 of the tool. The valve 59 is in a closed position preventing passage of fluid under pressure from the source 59 to the hose 55. The tool 21 then is lowered in the borehole 23 on the end of the pipe 27 with more pipe 27 and hose 55 added as needed. When the tool 21 reaches the desired level in the borehole in a formation of interest, for example, formation 101, the valve 59 is actuated to allow fluid under pressure from source 57 to pass to the hose 55 and hence to the chambers 45 and 47 by way of the passage 53. The fluid pressure in the chambers 45 and 47 forces the pistons 49 and 51 outward against the side wall of the borehole moving the tool 21 and its seal 37 against the other side wall of the borehole. The seal 37 thus seals off a portion of the formation of interest from the borehole fluid and prevents fluid in the borehole from entering the slot 33 but allows fluid from the formation 101 such as water, oil, etc. to pass into the slot 31 and up into passage 41 and into the pipe 27. From the pipe 27, the fluid can be conveyed to the surface by the use of an external lifting mechanism such as a conventional swabbing device which comprises an expandable cup attached to a sinker bar which can be lowered into the pipe 27 and then raised. The level at which the fluid will flow up into the pipe 27 depends upon the formation pressure. Instead of sampling fluid from the formation 101, fluid can be injected into the formation 101 from the surface by injecting fluid down the pipe 27.

After the testing or other operation is completed, the valve 59 is actuated to vent the pressure in the hose 55 to the atmosphere to release the pressure in the passage 53 and hence in the chambers 45 and 47 to allow the springs to return the pistons 49 and 51 to their retracted position in their chambers 45 and 47. The tool then can be removed from the borehole.

Since a producing formation is a hard formation, wash outs of the borehole normally will not occur at the producing zone and hence generally will not cause a problem since the seal 37 is intended to engage only the wall of the borehole in the producing formation. Since the slot 31 and seal 37 are elongated, a relatively large part of the formation can be isolated and tested. In addition, since the pistons 49 and 51 are in their retracted positions when the tool is lowered and raised, "hang up" of the tool in the borehole is unlikely to occur.

In one embodiment, the tool 61 has a diameter of six inches and a length of three feet. The slot 31 has a width of one inch and a length of eighteen inches. The seal 37 extends one-half of an inch outward from the plate 33 which in turn has a thickness of about 5/16 of an inch. The pistons 49 and 51 each have a maximum length of $4\frac{3}{4}$ inches. This tool is suitable for use in boreholes having a diameter of $7\frac{7}{8}$ inches. Tools of different diameters may be used in different size boreholes.

I claim:

1. A borehole tool, comprising:

an elongated tool member adapted to be located in a borehole at the level of a subsurface formation of interest, an elongated slot formed into said tool member from the exterior thereof along its length on one side, seal means on the exterior of said tool member surrounding the opening of said slot and extending outward beyond the outer wall of said tool member, first fluid passage means extending from said slot through a portion of said tool member to a first upper opening formed in said tool member for connection to a conduit adapted to extend to the surface, said first fluid passage means being continually open between said slot and said first upper opening, upper and lower spaced apart cylindrical chambers formed into said tool member from the exterior thereof on a side opposite said one side, upper and lower pistons located in said upper and lower cylindrical chambers respectively and adapted to be moved to outward and inward positions, second fluid passage means formed in said tool member for connection to a pressure control conduit adapted to extend to the surface, said second fluid passage means extending from a second upper opening formed in said tool member to said upper and lower cylindrical chambers for allowing fluid under pressure to be injected into said upper and lower cylindrical chambers for moving said upper and lower pistons outward for engaging one side of the borehole wall for moving said seal means of said tool member against the other side of the borehole wall, said second fluid passage means being continuously open between said second upper opening and said upper and lower cylindrical chambers, and means for returning said upper and lower pistons to their inward positions when the fluid pressure in said upper and lower cylindrical chambers is released.

2. The borehole tool of claim 1 wherein:

said means for returning said upper and lower pistons to their inward positions comprise spring means.

3. The borehole tool of claim 1 wherein each of said upper and lower pistons comprises:

an outward facing end for engaging the borehole wall and an opposite end located within its associated cylindrical chamber, an opening formed into said opposite end of said piston, a mechanical spring located in said opening of said piston, said spring having one end attached to said outward facing end of said piston and an opposite end attached to said tool member for normally maintaining said piston in its inward position and for returning said piston to its inward position from its outward position after the fluid pressure in its associated cylindrical chamber has been released.

4. The borehole tool of claim 3, comprising:

a pressure relief passage extending from each of said cylindrical chambers to the exterior of said tool member for releasing fluid pressure in said cylindrical chambers if said pistons travel beyond a given distance outward in each of said cylindrical chambers to limit the amount of outward distance of travel of said pistons.

5. A borehole system, comprising:

an elongated tool member adapted to be located in a borehole at the level of a subsurface formation of interest, an elongated slot formed into said tool member from the exterior thereof along its length on one side, seal means on the exterior of said tool member surrounding the opening of said slot and extending outward beyond the outer wall of said tool member, first fluid passage means extending from said slot through a portion of said tool member to an upper opening formed in said tool member, conduit means coupled to said upper opening and extending to the surface, upper and lower spaced apart cylindrical chambers formed into said tool member from the exterior thereof on a side opposite said one side, upper and lower pistons located in said upper and lower cylindrical chambers respectively and adapted to be moved to outward and inward positions, second fluid passage means extending into said tool member to said upper and lower cylindrical chambers, a pressure control conduit coupled to said second fluid passage means and extending to the surface to a source of fluid under pressure for allowing fluid under pressure to be injected into said upper and lower cylindrical chambers for moving said upper and lower pistons outward for engaging one side of the borehole wall for moving said seal means of said tool member against the other side of the borehole wall, valve means at the surface coupled to said pressure control conduit for providing a flow path between said source of fluid pressure and said pressure control conduit or for releasing the pressure in said pressure control conduit, and means for returning said upper and lower pistons to their inward positions when the fluid pressure in said upper and lower chambers is released.

6. The borehole system of claim 5, wherein:

said means for returning said upper and lower pistons to their inward positions comprise spring means.

7. The borehole system of claim 5 wherein each of said upper and lower pistons comprises:

an outward facing end for engaging the borehole wall and an opposite end located within its associated cylindrical chamber, an opening formed into said opposite end of said piston, a mechanical spring located in said opening of said piston, said spring having one end attached to said outward facing end of said piston and an opposite end attached to said tool member for normally maintaining said piston in its inward position and for returning said piston to its inward position from its outward position after the fluid pressure in its associated cylindrical chamber has been released.

8. The borehole system of claim 5, comprising:

a pressure relief passage extending from each of said cylindrical chambers to the exterior of said tool member for releasing fluid pressure in said cylindrical chambers if said pistons travel beyond a given distance outward in each of said cylindrical chambers to limit the amount of outward distance of travel of said pistons.

9. The borehole system of claim 5, wherein:

said first fluid passage means is continuously open between said slot and said upper opening to which said conduit means is coupled, said second fluid passage means is continuously open between said upper and lower cylindrical chambers and the position where said pressure control conduit is coupled to said second fluid passage means.

10. A borehole tool, comprising:

an elongated tool member adapted to be located in a borehole at the level of a subsurface formation of interest, an elongated slot formed into said tool member from the exterior thereof along its length on one side, seal means on the exterior of said tool member surrounding the opening of said slot and extending outward beyond the outer wall of said tool member, first fluid passage means extending from said slot through a portion of said tool member to a first opening formed in said tool member for connection to a conduit adapted to extend to the surface, said first fluid passage being continuously open between said slot and said first opening, chamber means formed into said tool member from the exterior thereof on a side opposite said one side, piston means located in said chamber means and adapted to be moved to outward and inward positions, second fluid passage means formed in said tool member for connection to a pressure control conduit adapted to extend to the surface, said second fluid passage means extending from a second opening formed in said tool member to said chamber means for allowing fluid under pressure to be injected into said chamber means for moving said piston means outward for engaging one side of the borehole wall for moving said seal means of said tool member against the other side of the borehole wall, said second fluid passage means being continuously open between said second opening and said chamber means, and means for returning said piston means to its inward position when the fluid pressure in said chamber means is released.

11. The borehole tool of claim 10 wherein:

said means for returning said piston means to its inward position comprise spring means.

12. The borehole tool of claim 10 wherein said piston means comprises:

an outward facing end for engaging the borehole wall and an opposite end located within said chamber means, an opening formed into said opposite end of said piston means, a mechanical spring located in said opening of said piston means, said spring having one end attached to said outward facing end of said piston means and an opposite end attached to said tool member for normally maintaining said piston means in its inward position and for returning said piston means to its inward position from its outward position after the fluid pressure in said chamber means has been released.

13. The borehole tool of claim 12, comprising:

a pressure relief passage extending from said chamber means to the exterior of said tool member for releasing fluid pressure in said chamber means if said piston means travels beyond a given distance outward in said chamber means to limit the amount of outward distance of travel of said piston means.

14. A borehole system, comprising:

an elongated tool member adapted to be located in a borehole at the level of a subsurface formation in interest, an elongated slot formed into said tool member from the exterior thereof along its length on one side, seal means on the exterior of said tool member surrounding the opening of said slot and extending outward beyond the outer wall of said tool member, first fluid passage means extending from said slot through a portion of said tool member to an upper opening formed in said tool member, conduit means coupled to said upper opening and extending to the surface, chamber means formed into said tool member from the exterior thereof on a side opposite said one side, piston means located in said chamber means and adapted to be moved to outward and inward positions, second fluid passage means extending into said tool member to said chamber means, a pressure control conduit coupled to said second fluid passage means and extending to the surface to a source of fluid under pressure for allowing fluid under pressure to be injected into said chamber means for moving said piston means outward for engaging one side of the borehole wall for moving said seal means of said tool member against the other side of the borehole wall, valve means at the surface coupled to said pressure control conduit for providing a flow path between said source of fluid pressure and said pressure control conduit or for releasing the pressure in said pressure control conduit, and means for returning said piston means to its inward position when the fluid pressure in said chamber means is released.

15. The borehole system of claim 14, wherein:

said means for returning said piston means to its inward position comprises spring means.

16. The borehole system of claim 14 wherein said piston means comprises:

an outward facing end for engaging the borehole wall and an opposite end located within said chamber means, an opening formed into said opposite end of said piston means, a mechanical spring located in said opening of said piston means, said spring having one end attached to said outward facing end of said piston means and an opposite end attached to said tool member for normally maintaining said piston means in its inward position and for returning said piston means to its inward position from its outward position after the fluid pressure in its associated chamber means has been released.

17. The borehole system of claim 14, comprising:

a pressure relief passage extending from said chamber means to the exterior of said tool member for releasing fluid pressure in said chamber means if said piston means travels beyond a given distance outward of said chamber means to limit the amount of outward distance of travel of said piston means.

18. The borehole system of claim 14, wherein:

said first fluid passage means is continuously open between said slot and said upper opening to which said conduit means is coupled, said second fluid passage means is continuously open between said chamber means and the position where said pressure control conduit is coupled to said second fluid passage means.

* * * * *